US009349344B2

(12) United States Patent
Ahn

(10) Patent No.: US 9,349,344 B2
(45) Date of Patent: May 24, 2016

(54) FLAT PANEL DISPLAY DEVICE

(71) Applicant: LG DISPLAY CO., LTD., Seoul (KR)

(72) Inventor: Seung-Kuk Ahn, Gumi-Si (KR)

(73) Assignee: LG DISPLAY CO., LTD., Seoul (KR)

( * ) Notice: Subject to any disclaimer, the term of this patent is extended or adjusted under 35 U.S.C. 154(b) by 127 days.

(21) Appl. No.: 13/692,653

(22) Filed: Dec. 3, 2012

(65) Prior Publication Data

US 2013/0278571 A1 Oct. 24, 2013

(30) Foreign Application Priority Data

Apr. 18, 2012 (KR) ..... 10-2012-0040345

(51) Int. Cl.
*G09G 5/00* (2006.01)
*G09G 3/20* (2006.01)

(52) U.S. Cl.
CPC ..... *G09G 5/006* (2013.01); *G09G 3/20* (2013.01); *G09G 2310/0221* (2013.01); *G09G 2310/08* (2013.01); *G09G 2330/06* (2013.01); *G09G 2370/08* (2013.01)

(58) Field of Classification Search
USPC ..... 345/88, 98, 100, 204, 205
See application file for complete search history.

(56) References Cited

U.S. PATENT DOCUMENTS

| | | | | |
|---|---|---|---|---|
| 7,310,094 | B2 * | 12/2007 | Baek | 345/213 |
| 7,812,833 | B2 * | 10/2010 | Kim et al. | 345/204 |
| 7,928,970 | B2 * | 4/2011 | Cho et al. | 345/205 |
| 2002/0149558 | A1 * | 10/2002 | Kashima et al. | 345/100 |
| 2006/0077197 | A1 | 4/2006 | Lin | |
| 2006/0232579 | A1 * | 10/2006 | Chen et al. | 345/211 |
| 2007/0052651 | A1 | 3/2007 | Kim et al. | |
| 2010/0149082 | A1 * | 6/2010 | Hong et al. | 345/88 |
| 2010/0302214 | A1 | 12/2010 | Kim et al. | |
| 2011/0032247 | A1 | 2/2011 | Hsieh et al. | |
| 2011/0157103 | A1 | 6/2011 | Chen et al. | |
| 2011/0157241 | A1 * | 6/2011 | Lee et al. | 345/690 |

FOREIGN PATENT DOCUMENTS

| | | |
|---|---|---|
| CN | 1928979 A | 3/2007 |
| CN | 101187739 | 5/2008 |

OTHER PUBLICATIONS

Office Action issued in corresponding United Kingdom Patent Application No. GB1220434.3, mailed Feb. 25, 2013.
Office Action issued in German Patent Application No. 102012110068.3, mailed May 15, 2014, 13 pages.
Office Action issued in Chinese Patent Application No. 201210443928.8, mailed Nov. 27, 2014, 12 pages.

* cited by examiner

*Primary Examiner* — Alexander Eisen
*Assistant Examiner* — Kebede Teshome
(74) *Attorney, Agent, or Firm* — Brinks Gilson & Lione

(57) ABSTRACT

A flat panel display device, which can reduce manufacturing costs is disclosed. The flat panel display device includes a display panel for displaying images and a plurality of driving integrated circuits for driving the display panel. Each of the plurality of driving integrated circuits includes a timing controller for arranging input image data such that the image data is suitable for driving of the display panel and generating a plurality of data control signals and a data driver for converting the image data provided from the timing controller into data voltages in response to the plurality of data control signals. Intervals during which the timing controllers of the driving integrated circuits supply clock signals to the data drivers of the corresponding driving integrated circuits are different.

5 Claims, 5 Drawing Sheets

FLAT PANEL DISPLAY DEVICE

This application claims the benefit of Korean Patent Application No. 10-2012-0040345, filed on Apr. 18, 2012, which is hereby incorporated by reference as if fully set forth herein.

BACKGROUND

1. Field of the Disclosure

The present disclosure relates to a flat panel display device which is capable of reducing manufacturing costs.

2. Discussion of the Related Art

Recently, flat panel display devices are being extensively used as display devices due to characteristics such as superior picture quality, light weight, thin thickness, and low power. The flat panel display device includes a liquid crystal display, an organic light emitting diode display, etc. and most of them are being commercially used.

A flat panel display device includes a display panel, a data driver Integrated Circuit (IC) for supplying data voltages to data lines of the display panel, a gate driver IC for supplying scan pulses to the gate lines of the display panel, and a timing controller for controlling the data driver IC and the gate driver IC.

The trend is for flat panel displays to have a large size and high resolution. Accordingly, an increase in the number of gate and data driver ICs is inevitable, thereby increasing manufacturing costs of the flat panel display device.

SUMMARY

A flat panel display device may include a display panel for displaying images, and a merged driving unit including a plurality of driving integrated circuits for driving the display panel, wherein each of the plurality of driving integrated circuits includes a timing controller that arranges input image data such that the image data is suitable for driving of the display panel and generates a plurality of data control signals, e.g. using synchronous signals, and a data driver for converting the image data provided from the timing controller into data voltages in response to the plurality of data control signals, and wherein intervals during which the timing controllers of the driving integrated circuits supply clock signals to the data drivers of the corresponding driving integrated circuits are different.

In various embodiments, a flat panel display device may include a display panel that displays images; and a plurality of integrated driving circuits that drive the display panel, wherein each of the plurality of driving integrated circuits includes a timing controller that arranges input image data such that the image data is suitable for driving of the display panel and generates a plurality of data control signals and a data driver that converts the image data provided from the timing controller into data voltages in response to the plurality of data control signals, and wherein the driving integrated circuits are configured to independently supply clock signals to the data drivers of the corresponding driving integrated circuits to control the data drivers timing controllers of the driving integrated circuits at non-overlapping time intervals.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
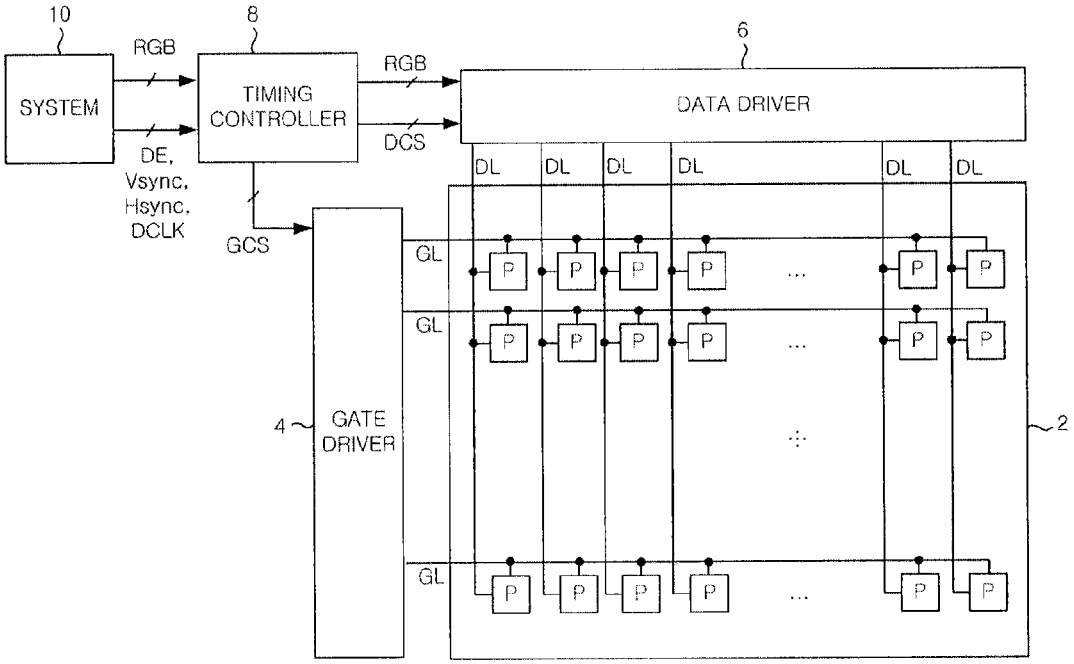
FIG. 1 is a block diagram illustrating the configuration of a flat panel display device according to an exemplary embodiment of the present invention.

FIG. 1 is a block diagram illustrating the configuration of a flat panel display device according to an exemplary embodiment of the present invention.

The flat panel display device illustrated in FIG. 1 includes a display panel 2, a gate driver 4, and a merged driving unit including a data driver 6 and a timing controller 8.

The display panel 2 includes a plurality of gate lines GL and a plurality of data lines DL which cross each other and a plurality of pixels P is formed in a cross region of the gate lines and data lines. The plurality of pixels P display images using scan pulses supplied from the gate lines GL and data voltages supplied from the data lines DL.

The gate driver 4 includes a gate shift register for supplying scan pulses to the plurality of gate lines GL according to a plurality of gate control signals GCS provided from the timing controller 8.

The data driver 6 of the merged driving unit converts digital image data RGB input from the timing controller 8 into data voltages using a reference gamma voltage according to a plurality of data control signals DCS provided from the timing controller 8 and supplies the converted data voltages to the plurality of data lines DL. The data driver 6 is integrated in driving ICs together with the timing controller 8. In other words, the data driver 6 and the timing controller 8 are integrated in one common package of a respective driving IC.

The timing controller 8 of the merged driving unit arranges the image data RGB input from a system 10 such that the image data RGB is suitable for the size and resolution of the display panel 2 and supplies the arranged image data to the data driver 6. The timing controller 8 generates the plurality of gate control signals GCS and data control signals DCS using synchronous singles input from the system 10 and supplies the gate control signals GCS and the data control signals DCS to the gate driver 4 and data driver 6, respectively. The synchronous signals include a dot clock signal and a data enable signal. The synchronous signals further can include a horizontal synchronous signal and a vertical synchronous signal. The plurality of gate control signals GCS includes a plurality of clock pulses and a gate start pulse which indicates the driving start of the gate driver 4. The plurality of data control signals DCS includes a source output enable signal for controlling an output interval of the data driver 6, a source start pulse indicating the start of data sampling, and a source sampling clock for controlling the sampling timing of data.

The merged driving unit is integrated in at least two driving ICs. Each of at least two driving ICs includes the timing controller 8 and the data driver 6.

Especially, the exemplary embodiment of the present invention reduces manufacturing costs by integrating the timing controller 8 and the data driver 8 in each of the driving ICs.

Figure 2:
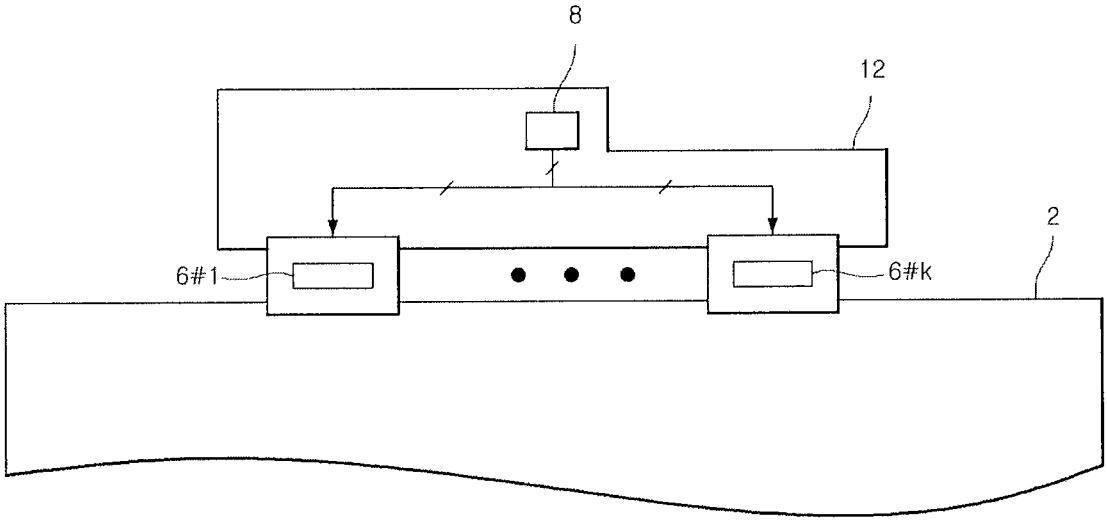
FIG. 2 is a diagram schematically illustrating the configuration of a conventional flat panel display device.

Namely, in a conventional flat panel display device, the timing controller 8 is mounted in a Printed Circuit Board (PCB) 12, and the data driver 6 includes a plurality of data driver ICs 6#1 to 6#k (where k is a natural number equal to or more than 2) which is mounted in a Tape Carrier Package (TCP) or a Chip-On-Film (COF) and then is connected between the PCB 12 and the display panel 2 using a Tape Automated Bonding (TAB) scheme, as shown in FIG. 2.

Figure 3:
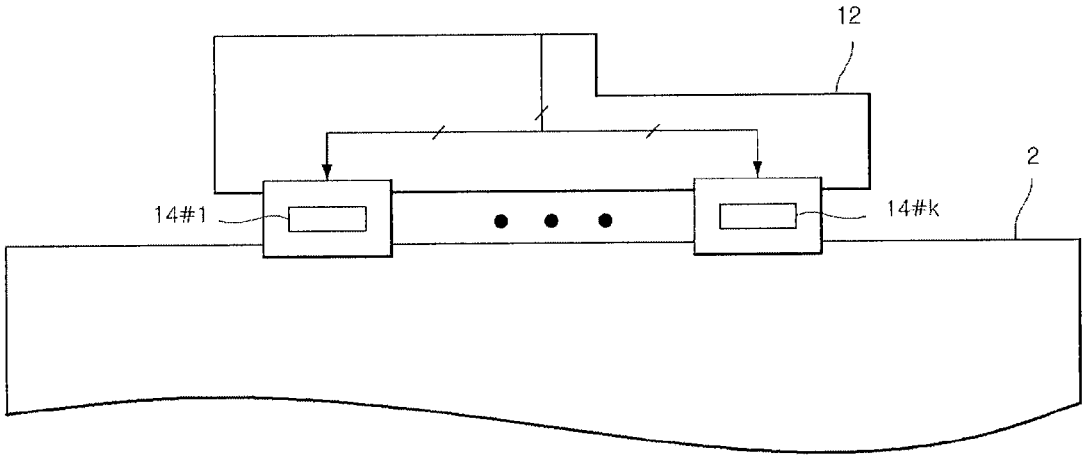
FIG. 3 is a diagram explaining a driving IC of the present invention.
Figure 4:
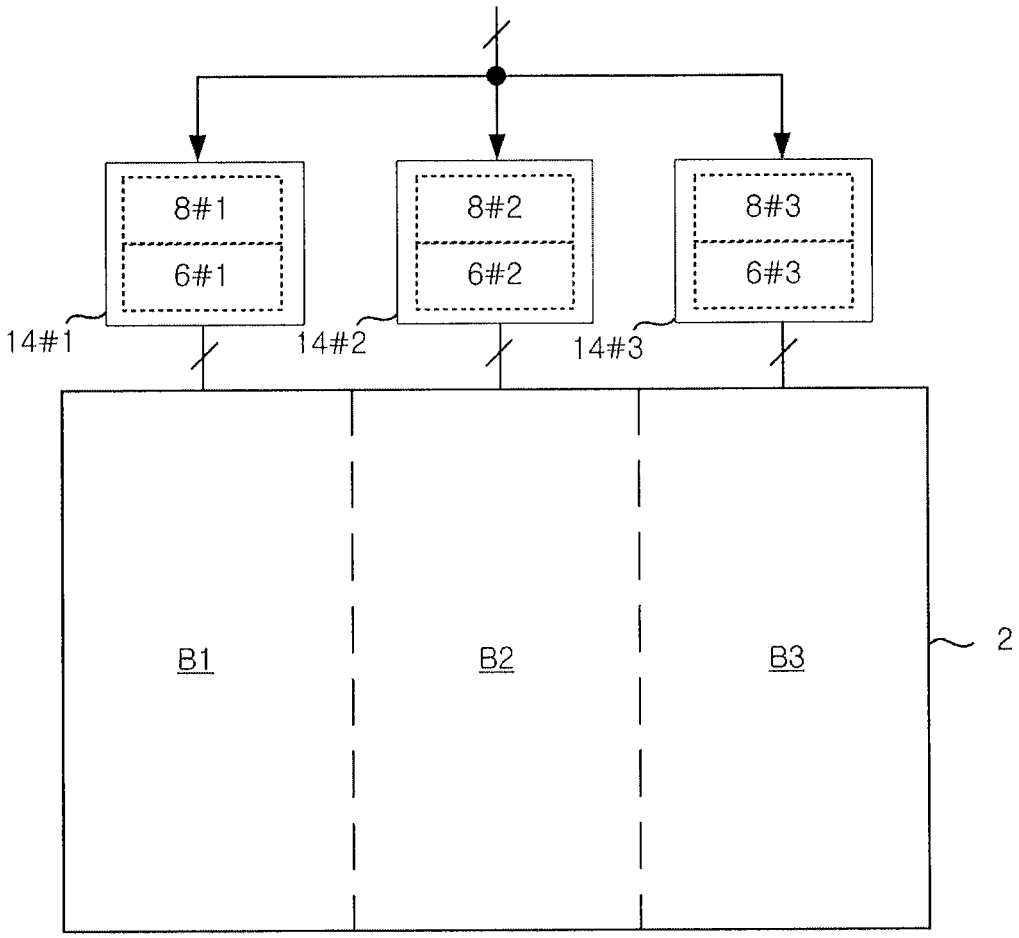
FIG. 4 is a block diagram explaining driving ICs according to an exemplary embodiment of the present invention.

However, according to the embodiment of the present invention, the merged driving unit including the timing controller 8 and the data driver 6 are integrated in driving ICs 14#1 to 14#k as shown in FIGS. 3 and 4, and the integrated driving ICs 14#1 to 14#k are mounted in a TCP or a COF and then are connected between the PCB 12 and the display panel 2 like the conventional data driver ICs 6#1 to 6#k. In the embodiment of the present invention, the timing controller 8 is deleted from the PCB 12 and is integrated in each of the driving ICs 14#1 to 14#k. Accordingly, the image data RGB and synchronous signals provided from the system 10 are supplied to the driving ICs 14#1 to 14#k via the PCB 12.

In this embodiment, IC manufacturing costs are saved due to the integration of the timing controller 8 and the data driver 6. In addition, the size of the PCB 12 is reduced by deleting a plurality of signal lines between the timing controller 8 and the plurality of data drive ICs 6#1 to 6#k on the PCB 12.

Hereinafter, the driving ICs 14#1 to 14#k according to an exemplary embodiment of the present invention will be described in detail. A different number of the driving ICs 14#1 to 14#k may be provided according to the resolution of the display panel 2 and IC manufacturing specification. The present invention can be applied when the number of the driving ICs 14#1 to 14#k is 2 or more. For convenience of description, the case where the number of driving ICs is 3 will be described hereinbelow.

FIG. 4 is a block diagram explaining the merged driving unit according to an exemplary embodiment of the present invention.

The merged driving unit includes a plurality of driving ICs 14#1 to 14#3 which is provided according to the resolution of a display panel 2. The driving ICs 14#1 to 14#3 include timing controllers 8#1 to 8#3 and data drivers 6#1 to 6#3, respectively. Each of the timing controllers 8#1 to 8#3 of the driving ICs 14#1 to 14#3 generates a plurality of data control signals DCS and supplies the data control signals DCS to each of the data drivers 6#1 to 6#3.

Namely, as illustrated in FIG. 4, the merged driving unit includes the first to third driving ICs 14#1 to 14#3.

The first driving IC 14#1 supplies data voltages to data lines DL corresponding to a first block B1 of the display panel 2. To this end, the first driving IC 14#1 includes a first timing controller 8#1 for arranging image data RGB provided from the system 10 and generating a plurality of data control signals DCS and includes a first data driver 6#1 for generating data voltages using the image data RGB and the plurality of data control signals DCS provided from the first timing controller 8#1 and supplying the data voltages to the first block B1 of the display panel 2.

The second driving IC 14#2 supplies data voltages to data lines DL corresponding to a second block B2 of the display panel 2. To this end, the second driving IC 14#2 includes a second timing controller 8#2 for arranging image data RGB provided from the system 10 and generating a plurality of data control signals DCS and includes a second data driver 6#2 for generating data voltages using the image data RGB and the plurality of data control signals DCS provided from the first timing controller 8#2 and supplying the data voltages to the second block B2 of the display panel 2.

The third driving IC 14#3 supplies data voltages to data lines DL corresponding to a third block B3 of the display panel 2. To this end, the third driving IC 14#3 includes a third timing controller 8#3 for arranging image data RGB provided from the system 10 and generating a plurality of data control signals DCS and includes a third data driver 6#3 for generating data voltages using the image data RGB and the plurality of data control signals DCS provided from the third timing controller 8#3 and supplying the data voltages to the third block B3 of the display panel 2.

Meanwhile, since each of the timing controllers 8#1 to 8#3 generates a plurality of data control signals DCS and gate control signals GCS having fast driving frequency, an increased number of the timing controllers 8#1 to 8#3 may increase electromagnetic interference (EMI). To prevent this interference, each of the timing controllers 8#1 to 8#3 of the driving ICs 14#1 to 14#3 generates a source sampling clock SSC only while a corresponding data driver samples data, and does not generate the source sampling clock SSC during the other duration which data drivers within the other driving ICs sample data. This will be described in detail below.

Figure 5:
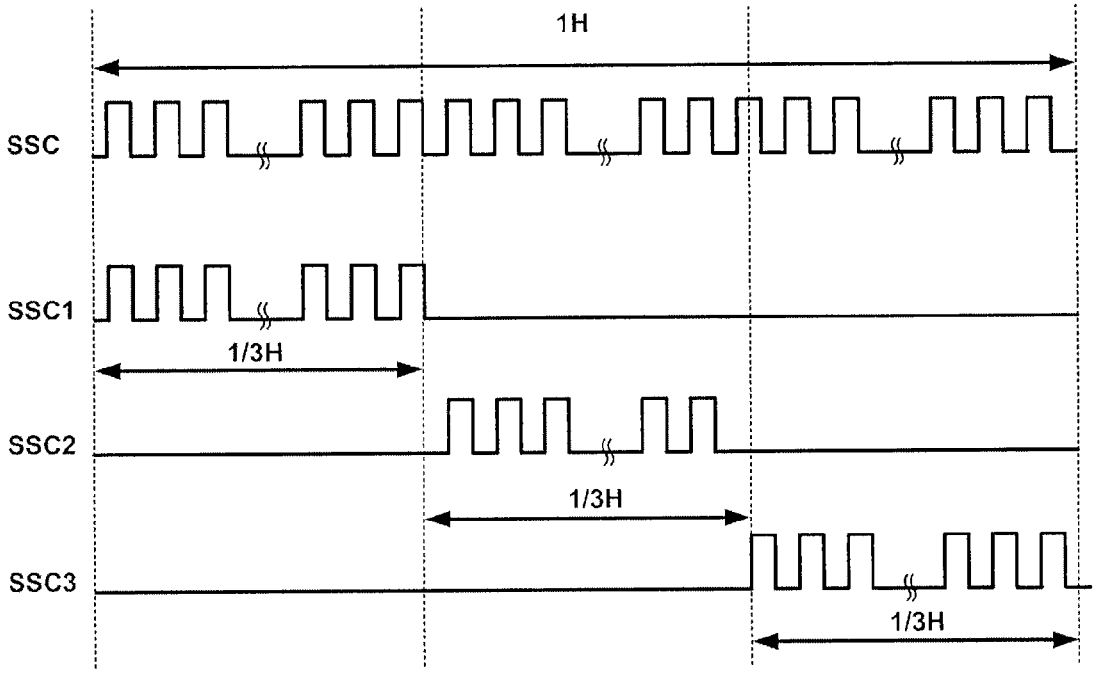
FIG. 5 is a waveform chart explaining a source sampling clock of the present invention.

FIG. 5 is a waveform chart explaining a source sampling clock of the present invention.

The first to third data drivers 6#1 to 6#3 sequentially latch image data during a one-horizontal interval in response to first to third source sampling clocks SSC1 to SSC3 provided from the first to third timing controllers 8#1 to 8#3, respectively. Next, the first to third data drivers 6#1 to 6#3 latch the image data corresponding to one horizontal line in parallel during the next horizontal interval, convert the image data into data voltages, and supply the data voltages to the data lines DL of the display panel 2.

Hereinafter, a sampling clock provided to the first data driver 6#1 from the first timing controller 8#1 is defined as a first source sampling clock SSC1, a sampling clock provided to the second data driver 6#2 from the second timing controller 8#2 is defined as a second source sampling clock SSC2, and a sampling clock provided to the third data driver 6#3 from the first timing controller 8#3 is defined as a third source sampling clock SSC3.

The first timing controller 8#1 supplies the first source sampling clock SSC1 to the first data driver 6#1 during a ⅓ horizontal interval (⅓H) while the first data driver 6#1 samples image data, and does not generate the first source sampling clock SSC1 during the other ⅔ horizontal interval (⅔H).

The second timing controller 8#2 supplies the second source sampling clock SSC2 to the second data driver 6#2 during a ⅓ horizontal interval (⅓H) while the second data driver 6#2 samples image data, and does not generate the second source sampling clock SSC2 during the other ⅔ horizontal interval (⅔H).

The third timing controller 8#3 supplies the third source sampling clock SSC3 to the third data driver 6#3 during a ⅓ horizontal interval (⅓H) while the third data driver 6#3 samples image data, and does not generate the third source sampling clock SSC3 during the other ⅔ horizontal interval (⅔H).

Thus, according to the exemplary embodiment, even if the number of the timing controller 8 is increased, source sampling clocks are generated by a Time Division Multiplexing (TDM) scheme according to the increased number. Therefore, EMI caused by an increase of the number of the timing controllers can be prevented from being increased.

As described above, according to the present invention, IC manufacturing costs can be reduced by integrating the merged driving unit, including the timing controller and the data driver, into at least two the driving ICs and PCB manufacturing costs can be saved by reducing the size of a PCB. In addition, since the timing controllers of the driving ICs generate source sampling clocks by a TDM scheme, an increase of EMI can be prevented due to integration of the timing controllers even though the number of timing controllers is increased.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A flat panel display device, comprising:

a display panel that displays images and that is divided into a plurality of blocks; and a plurality of driving integrated circuits corresponding to the plurality of blocks to drive the display panel, the plurality of driving integrated circuits being mounted on a circuit film, which is mounted between and on the display panel, and a printed circuit board, wherein each of the plurality of driving integrated circuits receives image data and synchronous signals directly from a system through the printed circuit board, wherein each of the plurality of driving integrated circuits includes a timing controller that arranges input image data such that the image data is suitable for driving of the display panel and generates a plurality of data control signals and a data driver for converting the image data provided from the timing controller into data voltages in response to the plurality of data control signals, the timing controller of each of the plurality of driving integrated circuits generating and supplying gate control signals to a gate driver, wherein the timing controllers of the driving integrated circuits are configured to independently supply clock signals to the data drivers of the corresponding driving integrated circuits, the clock signals non-overlapping each other, and the data drivers of the driving integrated circuits respectively sample the image data received from the timing controllers of the driving integrated circuits at non-overlapping time intervals according to the clock signals non-overlapping each other, wherein the driving integrated circuits receive signals directly from a system for directly controlling data lines in the corresponding blocks of the display panel and do not supply signals to another driving integrated circuit or another data driver, wherein the timing controllers generate source sampling clocks by a Time Division Multiplexing scheme, and wherein the timing controllers of the driving integrated circuits generate the source sampling clocks which oscillate between a high state and a low state for a single continuous time interval in a horizontal interval and do not generate the source sampling clocks outside the single continuous time interval in the horizontal interval, a sum of the single continuous time intervals corresponding to the driving integrated circuits is equal to the horizontal interval.

2. The flat panel display device of claim 1, wherein the timing controllers are configured to generate the clock signals only during an interval while the data drivers of the driving integrated circuits sample the image data.

3. The flat panel display device of claim 2, wherein the timing controllers sequentially generate the clock signals in the unit of a 1/n horizontal interval obtained by dividing one horizontal interval by n (where n is a natural number which is equal to or greater than 2).

4. The flat panel display device of claim 3, wherein the plurality of data control signals include:

a source output enable that controls an output interval of the data driver;

a source start pulse that indicates start of sampling of the image data; and a source sampling clock that controls timing of sampling of the image data, and wherein the clock signal is the source sampling clock.

5. A flat panel display device, comprising:

a display panel that displays images and that is divided into a plurality of blocks; and a plurality of driving integrated circuits corresponding to the plurality of blocks to drive the display panel, wherein each of the plurality of driving integrated circuits includes a timing controller that arranges input image data such that the image data is suitable for driving of the display panel and generates a plurality of data control signals and a data driver for converting the image data provided from the timing controller into data voltages in response to the plurality of data control signals, the timing controller of at least one of the driving integrated circuits generating and supplying gate control signals to a gate driver, wherein the timing controllers generate source sampling clocks by a Time Division Multiplexing scheme, and wherein the timing controllers of the driving integrated circuits generate the source sampling clocks which oscillate between a high state and a low state for a single continuous time interval in a horizontal interval and do not generate the source sampling clocks outside the single continuous time interval in the horizontal interval, a sum of the single continuous time intervals corresponding to the driving integrated circuits is equal to the horizontal interval.

* * * * *